US006341779B1

(12) United States Patent
Merritt

(10) Patent No.: US 6,341,779 B1
(45) Date of Patent: Jan. 29, 2002

(54) MATHEMATICAL CARD AND DICE GAME

(76) Inventor: Arthur Merritt, 81 Bradford Rd., Tewksbury, MA (US) 01876

( * ) Notice: Subject to any disclaimer, the term of this patent is extended or adjusted under 35 U.S.C. 154(b) by 0 days.

(21) Appl. No.: 09/692,400

(22) Filed: Oct. 19, 2000

(51) Int. Cl.[7] ..... A63F 1/00

(52) U.S. Cl. ..... 273/292; 273/272; 434/188; 434/191

(58) Field of Search ..... 273/146, 292, 273/299, 272, 302, 304, 307, 306; 434/188, 191, 193, 194, 195, 205, 209; 463/9, 11

(56) References Cited

U.S. PATENT DOCUMENTS

| | | | | | |
|---|---|---|---|---|---|
| 3,314,168 | A | | 4/1967 | Heckman | |
| 3,652,086 | A | | 3/1972 | Stecker | |
| 3,959,893 | A | * | 6/1976 | Sigg | 35/31 |
| 4,017,080 | A | * | 4/1977 | Severson | 273/135 R |
| 4,114,290 | A | * | 9/1978 | Cooper | 35/31 R |
| 4,258,922 | A | * | 3/1981 | Landry | 273/302 |
| 4,443,012 | A | | 4/1984 | Makovic | |
| 4,452,588 | A | * | 6/1984 | Smith | 434/207 |
| 5,176,381 | A | * | 1/1993 | Winters | 273/146 |

* cited by examiner

*Primary Examiner*—Jessica J. Harrison
*Assistant Examiner*—Alex F. R. P. Rada, II

(57) ABSTRACT

A mathematical card and dice game comprising a deck of cards, a set of three dice, and a timing device, the deck of cards divided into four suits of fifteen cards each, ten of which are numbered one through ten, the remaining five non-numeric cards having letters which can take on any value as defined by the players prior to the game. A predetermined number of cards are dealt to players who use the values of the three dice rolled, common mathematical operations such as addition, subtraction, multiplication, and division, and their knowledge of math to make mathematical relationships that equate to the value of cards in their hands within a predetermined amount of time as tracked by a timing device. A successful match occurs when the card value equals the numeric result of a mathematical operation involving all three dice. Players place successful matching cards face down until the end of the round, when the time limit is up, wherein they turn the cards over and must be able to successfully explain the relationship the card value has to the dice values. Players take turns rolling the dice and starting the timer between rounds. The first player to discard all their cards is the winner. Penalty cards are assessed when players cannot correctly explain the relationship the card has to the dice or when they cannot discard any card during a round.

2 Claims, 6 Drawing Sheets

MATHEMATICAL CARD AND DICE GAME

CROSS-REFERENCE TO RELATED APPLICATIONS

Figure 1A:
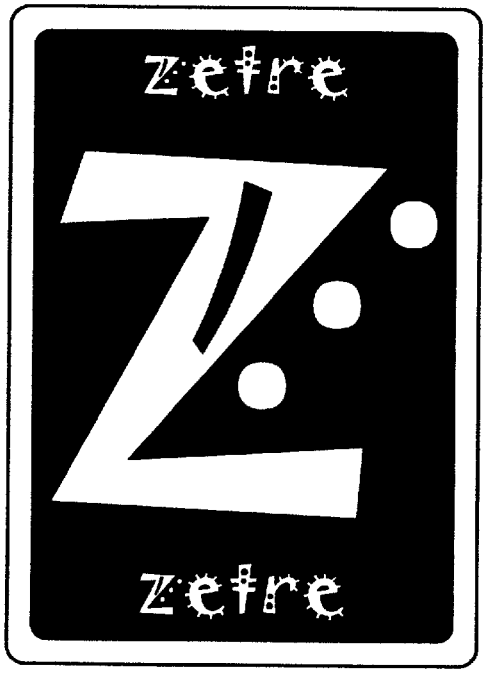

Not Applicable.

BACKGROUND—FIELD OF INVENTION

This invention relates to games in which playing cards and dice are used.

BACKGROUND—DISCUSSION OF PRIOR ART

There are of course numerous card games, and many card games that include the use of one or more dice. The object and purpose of the game, the rules of the game, the types of cards and dice used, and the method of use of the cards and dice vary amongst these other games. The game described and claimed herein is believed to be unique.

Some of these card and dice games patented involve matching cards or the suits of cards to dice based on the value of the individual die or the design on the die. The matching is done without the use of mathematical operations being performed on the dice.

Other games in this category involve adding the values of two dice to be used as one value. The use of this value in the context of these games as well as the object and purpose of these games vary widely.

These games do not involve players developing multiple mathematical equations involving the values of the dice to produce a result that equates to a numeric value of a card.

There is one educational tool, U.S. Pat. No. 3,314,168 to Heckman (1967), that uses dice imprinted with numbers and operators to equate to a value of card. The order of mathematical operations, the order of the dice values used, and the type of operations that may be used are constrained by the rules and dice used. The player does not have the freedom to arrange the dice in any order or use any of their own mathematical operations.

SUMMARY

The game presented here in is an educational, entertaining card and dice game in which cards are matched to the values of dice based on a valid mathematical relationship of the dice to the value of the card in a predetermined amount of time.

OBJECTS AND ADVANTAGES

One object of the present invention is to provide a game with a mathematical challenge.

Another object of the present invention is to provide an entertaining game for one or more players.

Another object of the present invention is to provide an educational mathematical learning game.

Another object of the present invention is to provide a game that requires fast thinking.

Another object of the present invention is to provide a game that can be customized to the skill of the players.

Another object of the present invention is to provide a game that can be played in multiple ways.

Another object of the present invention is a game that can be modified by its participants.

Another object of the present invention is a game that can be played by all participants at the same time.

Another object of the present invention is to provide a game that can be enjoyed by a wide range of ages including children and adults.

Accordingly, one advantage of the present invention is the educational aspect of the game in regards to the broad range of mathematical operations that may be applied to the values of the dice to achieve a valid match with a player's card.

Another advantage is the game allows all players to play at the same time during each round rather than players taking turns.

Another advantage is the game can be played alone as well as with multiple players.

Another advantage is the game is expandable and offers multiple possibilities in terms of rules and how to play.

Another advantage is the degree of difficulty can easily be adjusted to suit the skills of the players.

Another advantage is that there is a time limit per round, which can create excitement and can affect the play of the game.

Another advantage is the game is for all ages—the degree of flexibility provided by this game allows people of all ages and skill to enjoy it.

Additional benefits and features of the game will become apparent from a consideration of the ensuing description and drawings.

DRAWING FIGURES

In the drawings, closely related figures have the same number but different alphabetic suffixes.

Figure 1B:
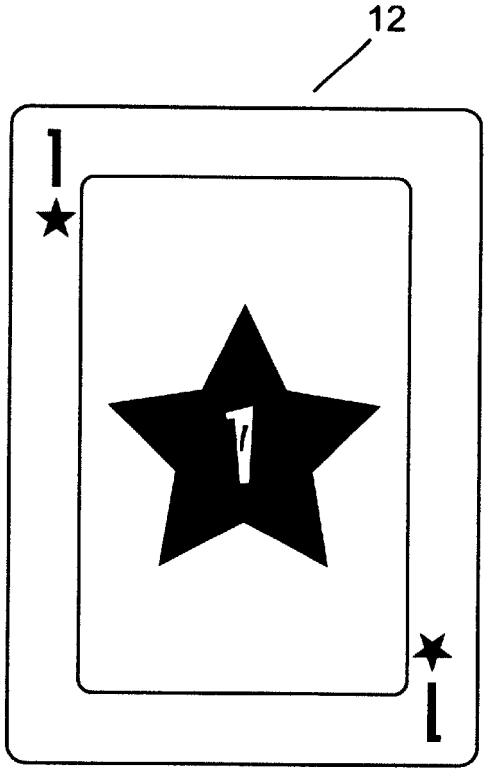
Figure 1C:
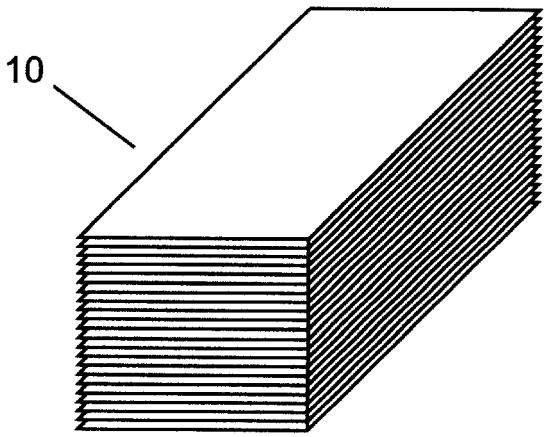
Figure 1D:
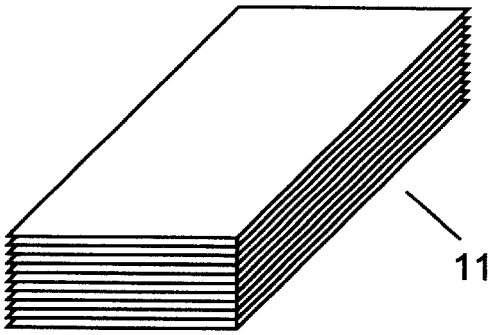
Figure 1E:
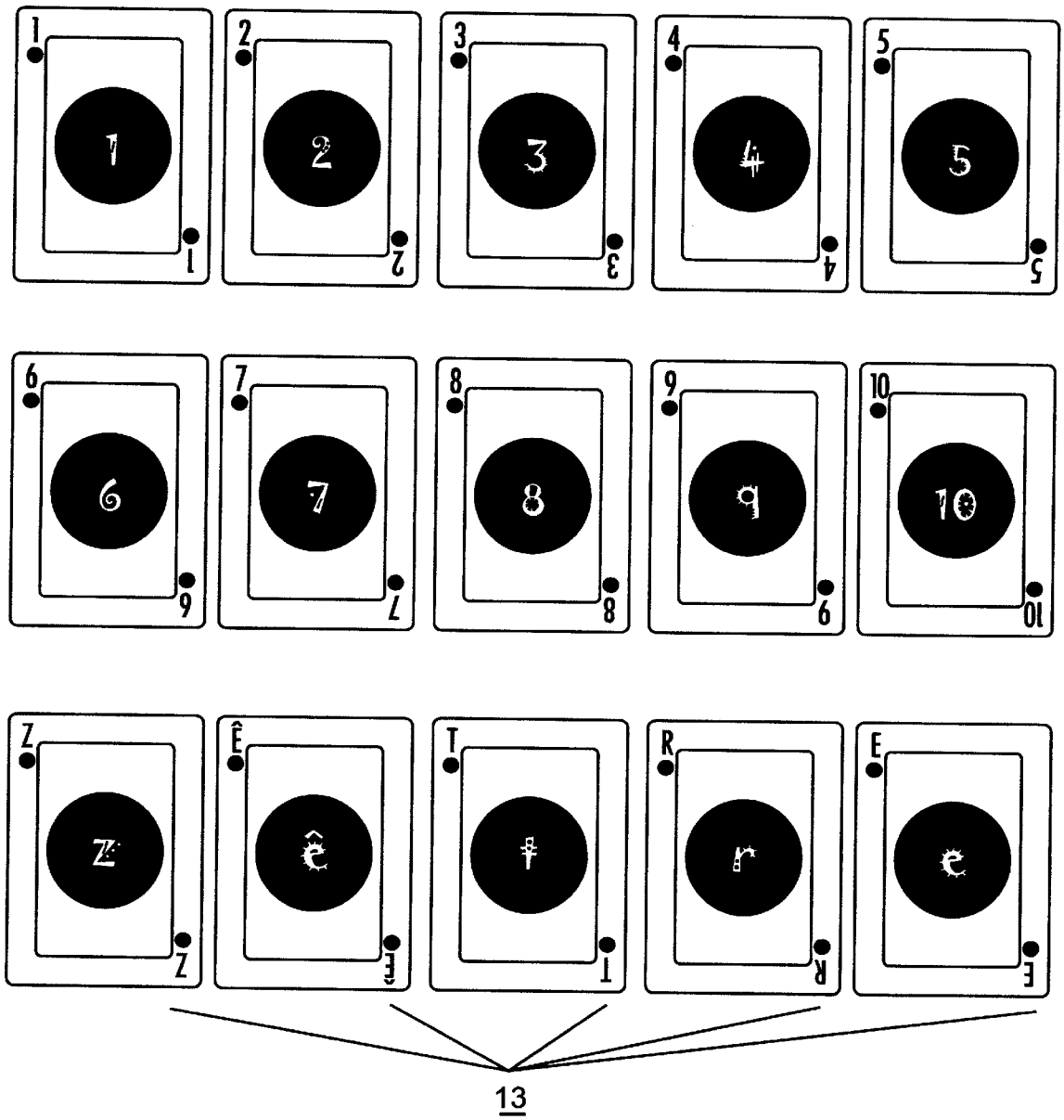
Figure 1F:
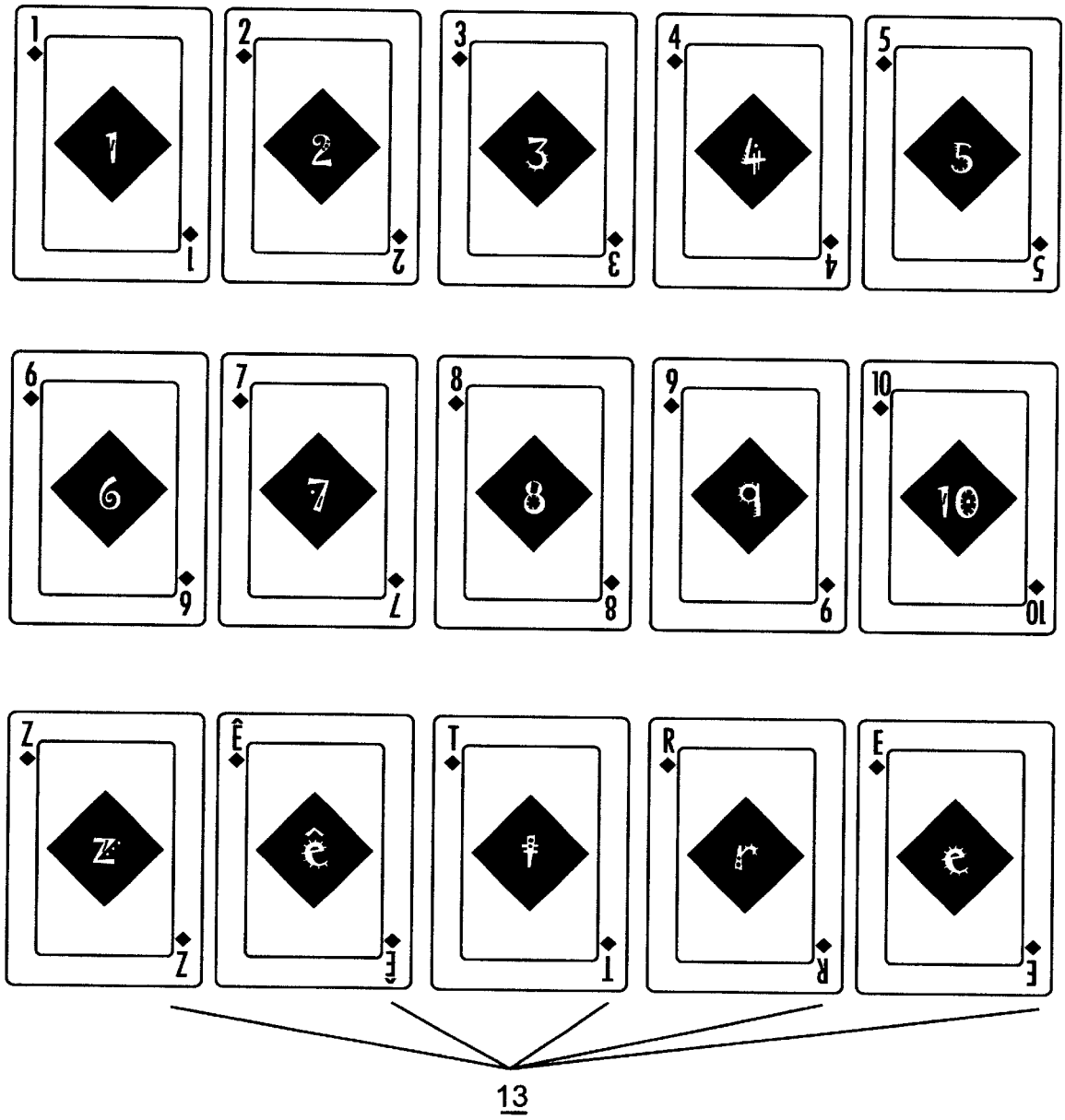
Figure 1G:
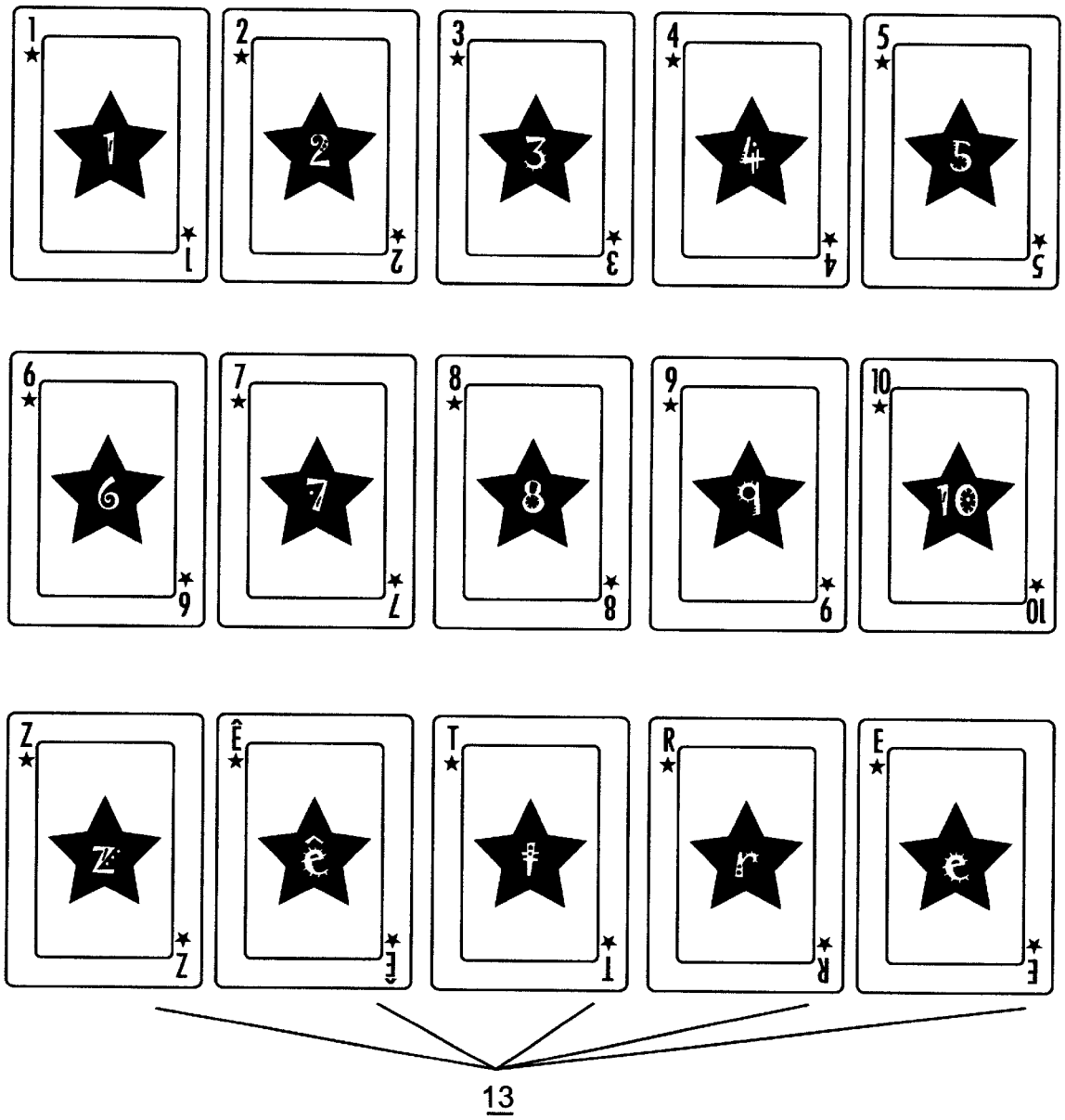
Figure 1H:
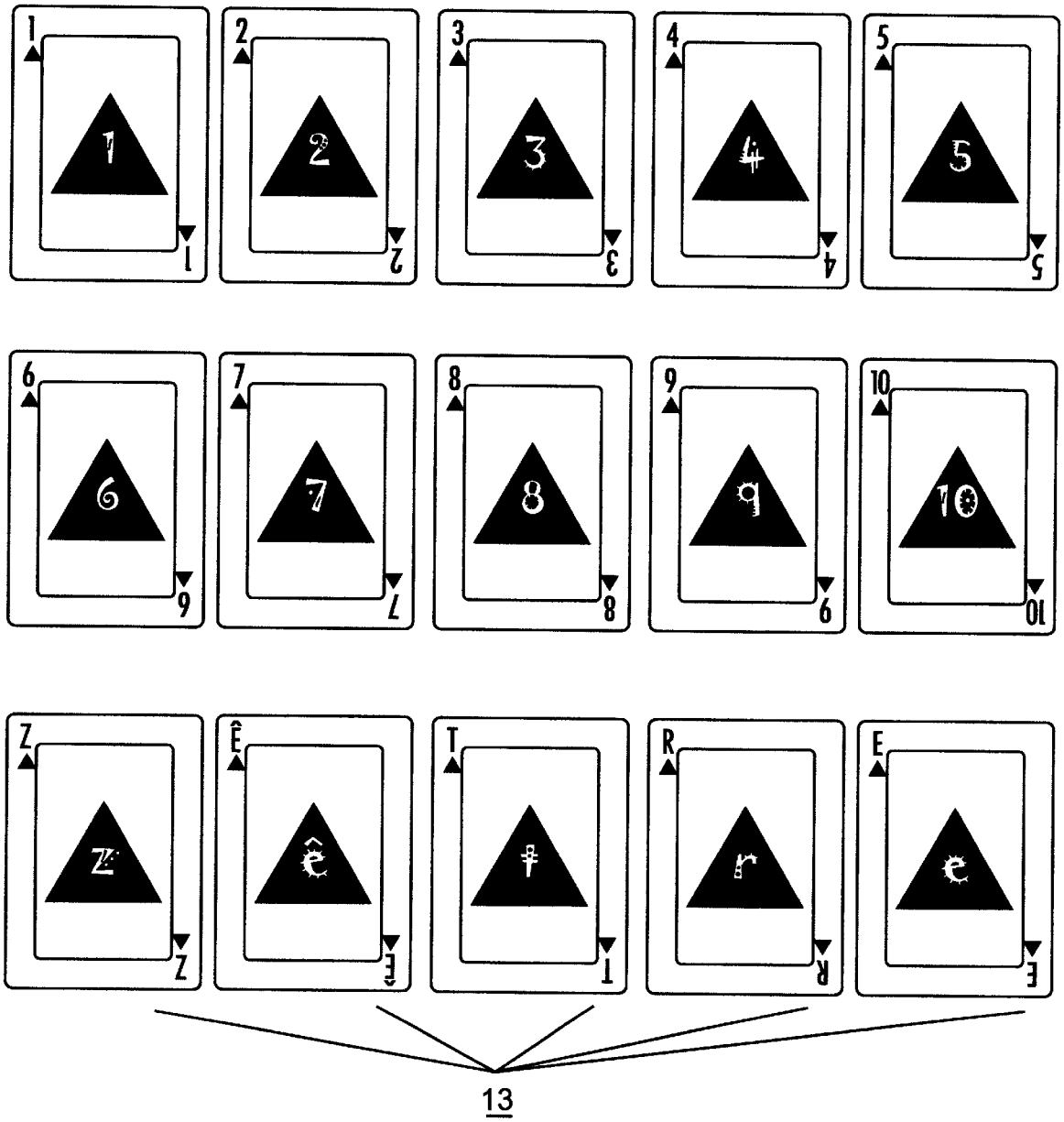

FIGS. 1A to 1H show various aspects of the playing cards used in the game. FIGS. 1A and 1B show that each card has a back, 1B, and front, 1A. FIG. 1C shows a deck of cards. FIG. 1D shows a stack of cards representing the remaining cards after the cards are dealt commonly referred to as a draw pile. FIGS. 1E to 1H show that the deck of cards is divided into four suits with fifteen cards, ten of which are numbered one through ten, the remaining five having the letters "Z", "Ê", "T", "R", and "E" respectively.

Figure 2A:
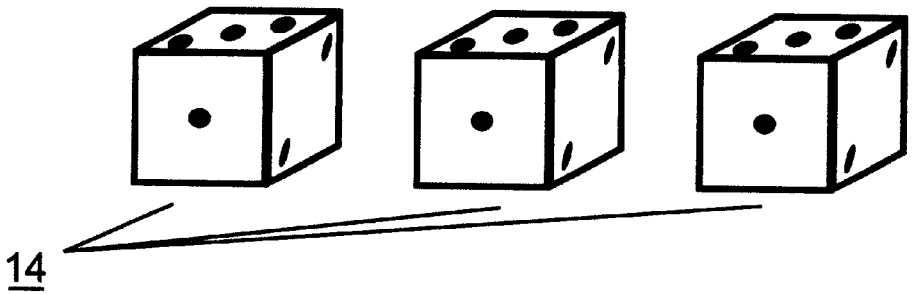
Figure 2B:
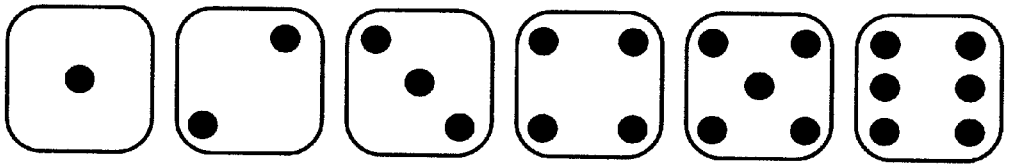

FIGS. 2A and 2B shows the dice used in the game. These are ordinary game dice, which are cubes with six sides. Each side has a different number of dots, one through six as displayed in FIG. 2B.

Figure 3:
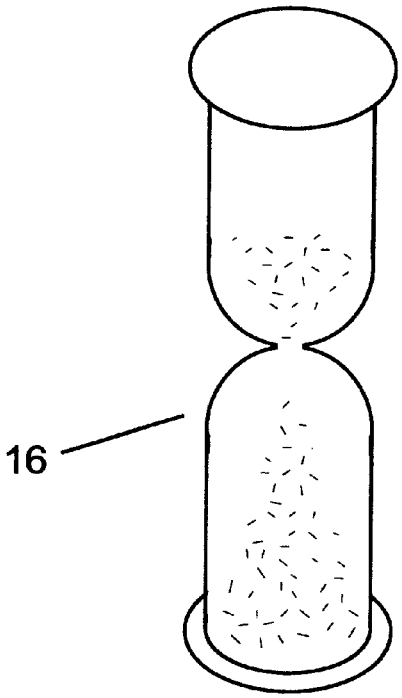

FIG. 3 shows one possible timing device used in the game—a sand timer.

REFERENCE NUMERALS IN DRAWINGS

10. Deck of Cards
11. Draw Pile
12. Card Face
13. Non-Numeric Cards
14. Set of three Dice
16. Timing Device

DESCRIPTION

A card and dice game comprising a Deck of Cards 10, a set of three Dice 14, and a Timing Device 16.

A Deck of Cards 10 divided into four suits of fifteen cards each, ten of which are numbered one through ten, the remaining five having the letters "Z", "Ê", "T", "R", and "E" respectively. Each card has its value printed on the upper left corner, the center, and mirrored on the bottom right corner as evident on Card Face 12. The suit's symbol is imprinted on the upper left, the center, and mirrored on the bottom right.

A set of Dice 14 are provided as shown in FIG.2, which may be ordinary game dice, each in the form of a cube with six square sides, each side having one or more dots thereon respectively from one through six dots.

A Timing Device 16 to monitor time allotted per round of the game. The device may be in the form of but not limited to a sand timer, electronic timer, or mechanical timer.

Operation

There are numerous ways in which the game may be played both alone and with multiple players. The preferred embodiment is as follows.

In the basic multi-player game, the players decide at the beginning what the values of the Non-Numeric Cards 13 will be. The default is to have the "Z" be worth eleven, the "Ê" to be twelve, the "T" to be thirteen, the "R" to be fourteen, and the "E" to be fifteen. The numeric cards are their respective values.

Each player is dealt seven cards from the shuffled Deck 10. The remaining cards form the Draw Pile 11. Players take turns rolling the Set of Dice 14 to see who goes first. The player with the highest total sum of the Set of Dice 14 goes first. The remaining players go in clockwise order starting after the first person.

On a player's turn, the player rolls all three Dice 14. The Timing Device 16 is started. All players have as much time as allocated by the Timing Device 16, 30 seconds for example, to remove as many cards as they can from there hand by making valid mathematical relationships to the values of the dice.

Valid mathematical relationships are those that use all three values of Dice 14 at least once and only once in any order, use mathematical operations comprising but not limited to addition, subtraction, multiplication, and division, in any order and with parenthesis, and result in a value equal to the value of one or more cards in a player's hand.

For instance, if the values of Dice 14 are 2, 3, and 5, some valid mathematical combinations are$(2\times3)+5,(5\times2)+3,2+3+5,5-3-2,5-3+2,(5-3)/2,(5-2)\times3$, and so on. If a player has a card in their hand with a value equal to the result of any of these operations they can discard the card. Thus a player holding a nine can discard it because $(5-2)\times3=9$.

A player can discard as many cards as they can per round by making as many valid mathematical relationships they can with the dice values rolled.

Cards are discarded face down. If a player cannot remove any card, he must draw a card from the Draw Pile 11 as a penalty when the round is over. The round is over when the time allotment has expired.

At the end of the round, each player turns their discarded cards face up and has to successfully explain the relationship of each card they discarded to the Dice 14. If they cannot successfully explain the relationship, the must pick up the invalid card(s) and draw one additional card from the Draw Pile 11 for each invalid card they discarded as a penalty.

The next round begins when the player next in turn roles the Dice 14 and the Timing Device 16 is started. Each player again tries to discard cards in the manner described.

Play continues until one player has no cards remaining. The first player to discard all their cards is the winner.

If in the event the Draw Pile 11 runs out of cards, the discarded cards are to be shuffled and put into the Draw Pile 11.

The degree of difficulty of the game can be adjusted by removing certain value cards from the deck, modifying the value of the non-numeric cards, adding or removing valid mathematical operators, or by increasing or decreasing the time allotted.

Description and Operation of Alternative Embodiments

There are numerous additional ways to play the game as well as rules to add.

One alternative is a longer version of the basic game. The main additional feature of this game is as follows: at the end of each round, players must pick up half as many cards from the Draw Pile 11 as they have in their hand rounded up to the nearest integer. For instance, if a player has three cards remaining in their hand, they need to pick up two additional cards from the Draw Pile 11 prior to the next round. This extends the game play time.

Other rules that can be added to modify the difficulty include a provision for rolling triplets—the condition when all three values of Dice 14 have the same value. Players can decide before hand the consequence or reward for rolling such a sequence. At the same time, the non-numeric cards can be treated as "wild" cards taking on whatever value the players wish.

The amount of cards dealt to each player can be adjusted to change the length and difficulty of the game.

The time limit set by the Timing Device 16 can also be adjusted to change the degree of difficulty of the game.

A point system can be added to the game similar to Rummy 500, in which the players attempt to reach a certain number of points the fastest.

Additional card values and different types of dice can be used to expand the game. For instance, 8 sided and 10 sided dice may be used.

The game has the added ability of being able to be played alone. The solitaire player can play against the clock or utilizing a point system.

Conclusion, Ramifications, and Scope

Thus the reader will see that this is a unique card and dice game, that offers a fun, educational form of entertainment with the flexibility to be customized to the enjoyment of the participants.

While the description above contains many specifications these should not be construed as limitations on the scope of the invention, but rather as an exemplification of one preferred embodiment thereof Many other variations are possible. For example, the game can be modified in terms of the values of cards put into play, the length of time allowed per round, the number and type of cards dealt, and the types of acceptable mathematical operations allowed. Additionally, this unique Deck of Cards 10 can be used in other manners and games.

I claim:

1. A method of utilizing a game apparatus by one or more players, including selection of a deck of cards having a plurality of cards organized in different suits with each suit comprising a plurality of cards with numeric values and a plurality of cards with non-numeric values, selection of a plurality of random-number generating devices, and selection of a timing device wherein the method of play comprises the steps of:

(a) assigning numeric values to the non-numeric cards and determining other use of said cards with non-numeric values;

(b) selecting the order in which players take turns operating said random-number generating devices;

(c) shuffling said deck of cards and dealing a predetermined number of cards to each player;

(d) commencing a new round upon each player's turn, starting said timing device and operating said random-number generating devices;

(e) upon commencing each round, all players attempting to discard cards face down from their hands by forming valid mathematical operations using all the values of said random-number generators and a pre-defined list of acceptable mathematical operators and successfully equating the results to a value of a card in the player's hand;

(f) players attempting to form multiple different valid mathematical operations using all the values of said random-number generators and a pre-defined list of acceptable mathematical operators to achieve different results that successfully equate to a value of a card in the players hand to discard as many cards as possible during a round;

(g) upon said timing device reaching time limit and round ending, each player displaying discarded cards and successfully explaining the relationship each of their discarded card has to the values of said random-number generators;

(h) upon incorrectly discarding a card, each player unsuccessful at explaining the mathematical relationship of their discarded card, or cards, picking up the incorrect card as well as an additional penalty card for each incorrectly discarded card;

(i) in the event a player cannot not discard any card during a round, player picking up an addition penalty card at the end of the round;

(j) repeating steps (d) through (i) until one player successfully discards all their cards.

2. The game of claim 1 wherein the following step (k) is added after step (i) and before step (j): at the end of each round after penalty cards are assessed, each player must pick up an additional amount of cards equal to one half of the number of cards they currently have in their hand rounded up to the nearest integer.

* * * * *